United States Patent [19]

Berglund

[11] Patent Number: 4,902,256

[45] Date of Patent: Feb. 20, 1990

[54] WATER SKI WEDGE

[76] Inventor: Randy E. Berglund, 9675 Laughlin Way, Redwood Valley, Calif. 95470

[21] Appl. No.: 271,292

[22] Filed: Nov. 15, 1988

[51] Int. Cl.[4] ..... A63C 15/00

[52] U.S. Cl. ..... 441/68; 441/74

[58] Field of Search ..... 441/65, 68, 70, 74, 441/76; 280/607, 636

[56] References Cited

U.S. PATENT DOCUMENTS 3,119,130 1/1964 Senne et al. ..... 441/70
4,305,603 12/1981 Müller ..... 441/65 X
4,320,905 3/1982 Andrew et al. ..... 441/65 X
4,568,296 2/1986 Newell ..... 441/70

*Primary Examiner*—Sherman D. Basinger
*Attorney, Agent, or Firm*—H. Jay Spiegel

[57] ABSTRACT

The present invention relates to a wedge device designed to be mounted on a water ski in a position where the wedge will underlie the rear foot of the skier. The wedge only supports the rear portion of the foot and allows the ball of the foot to directly contact the ski and thereby helps achieve proper slalom skiing body position with improved balance, stability, ski control, consistency and performance.

12 Claims, 2 Drawing Sheets

FIG. 3
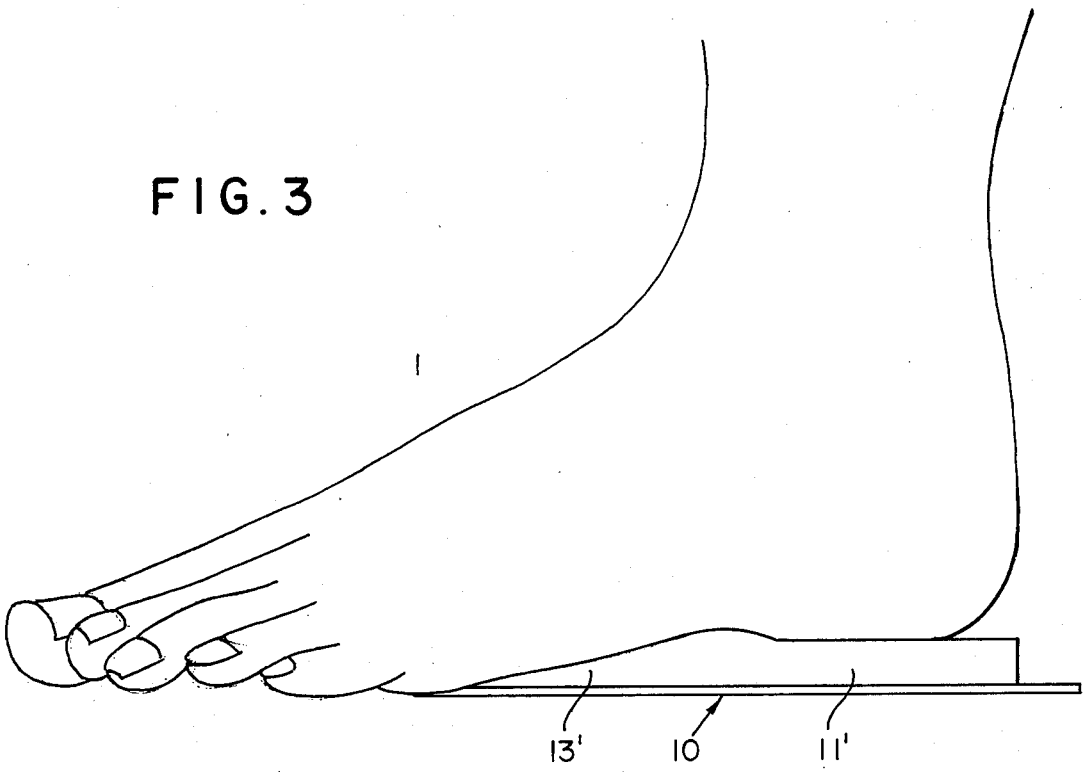
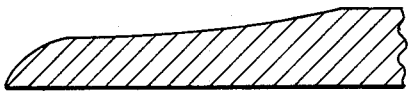
FIG. 4
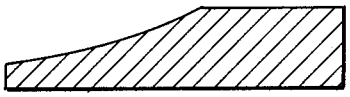
FIG. 7
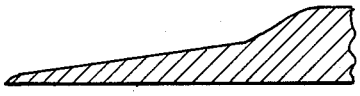
FIG. 5
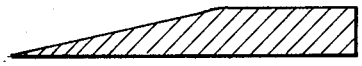
FIG. 8
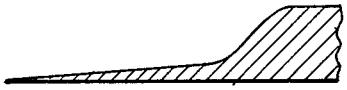
FIG. 6
FIG. 9
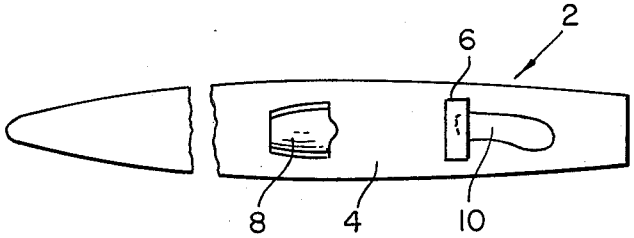

WATER SKI WEDGE

BACKGROUND OF THE INVENTION

The present invention relates to a water ski wedge. In the prior art, it is known to mount a cushion structure on a water ski to support the foot of a skier. U.S. Pat. No. 3,119,130 to Senne et al and U.S. Pat. No. 4,568,296 to Newell each disclose such a device. However, in each patent, the cushion device is specifically designed to support the entire foot and, thus, no portion of the foot engages the ski itself.

The present invention differs from the teachings of these patents in that for the specific purposes disclosed hereinafter, the wedge structure of the present invention only supports the rearwardmost portion of the foot, allowing the ball of the foot and portions forward thereof to engage the ski.

SUMMARY OF THE INVENTION

The present invention overcomes the deficiencies found in the prior art and provides a new and improved wedge structure designed to be mounted on a water ski to improve the use thereof.

The present invention includes the following interrelated aspects and features:

(a) Firstly, the present invention is intended to be used on what is known as "slalom" ski. A slalom ski is a ski having two toe pieces or bindings so that the skier may support his or her body totally on a single ski with one foot in front of the other.

(b) The present invention consists of a wedge-shaped structure designed to mounted on the top surface of a slalom water ski in a position where the rear foot will be placed, with the wedge extending from just behind the ball of the foot to beyond the heel thereof.

(c) The wedge is contoured to the lateral side of the foot, sloping downwardly from the heel in the direction of the toes with a transverse slope sloping downwardly from the lateral side of the foot to the medial side of the foot.

(d) The wedge includes no arch support and a level heel platform which spaces the heel from the top surface of the water ski by approximately one half inch.

(e) This structure allows the ball of the rear foot to be in direct contact with the ski with those portions of the foot rearward thereof being supported by the wedge.

(f) In the preferred embodiment of the present invention, the material used in making the wedge is firmly flexible while being able to withstand the detriments of weathering from sunlight, salt water, etc.

(g) The teachings of the present invention markedly contrast with the teachings of U.S. Pat. No. 4,568,296 to Newell in that the Newell patent theorizes to position the feet, legs, knees and hips of a water skier in the natural or neutral position through the use of two corrective wedges, the one for the front foot sloping downwardly from toe to heel with a transverse slope sloping downwardly from the medial side to the lateral side of the foot. The other corrective wedge for the rear foot slopes downwardly from heel to toe with a transverse slope sloping downwardly from the medial side to the lateral side of the skiers foot. It is noted that the medial side of the foot is the inside of the foot whereas the lateral side of the foot is the outside of the foot.

(h) Using the teachings of Newell, pressure on the feet is directed toward the heels and the lateral side of each foot which, in turn, causes the knees of the water skier to spread further apart the more the knees are bent which inherently places the skier out of the proper slalom body position. As is understood by those skilled in the art, the knees should be tucked one behind the other at all times with the hips being in forward position directly over the space between the feet with the back straight and perpendicular to the plane of the ski. This body position is not possible using the teachings of Newell. As such, the present invention is believed to be clearly distinct from the teachings of Newell for these reasons and further because the Newell wedges completely support the feet not allowing any portion of the feet to engage the ski itself.

(i) In contrast to the teachings of Newell, the water ski wedges disclosed herein function by directing most of the pressure on the feet to the balls of the feet thereby keeping the knees comfortably tucked one behind the other at all times. Furthermore, the water ski wedge helps to bring the hips forward for a strong and proper slalom body position.

Accordingly, it is the first object of the present invention to provide an improved water ski wedge.

It is further object of the present invention to provide such an improved water ski wedge which is designed to support that portion of the rear foot as placed on a water ski which is behind the ball portion thereof.

It is yet a further object of the present invention to provide such a water ski wedge which is designed to cause a chain reaction resulting in proper positioning of the body of the skier during water skiing.

These and other objects, aspects and features of the present invention will be better understood from the following detailed description of the preferred embodiment when read in conjunction with the appended drawings figures.

BRIEF DESCRIPTION OF THE DRAWINGS

FIG. 3 shows a side view corresponding to the configuration of FIG. 2.

FIG. 4 shows a cross-sectional view along the line 4—4 of FIG. 1.

FIG. 5 shows a cross-sectional view along the line 5—5 of FIG. 1.

FIG. 6 shows a cross-sectional view along the line 6—6 of FIG. 1.

FIG. 7 shows a cross-sectional view along the line 7—7 of FIG. 1.

FIG. 8 shows a cross-sectional view along the line 8—8 of FIG. 1.

FIG. 9 shows a top view of a slalom water ski having the wedge illustrated in FIG. 1 mounted thereon.

SPECIFIC DESCRIPTION OF THE PREFERRED EMBODIMENTS

Figure 1:
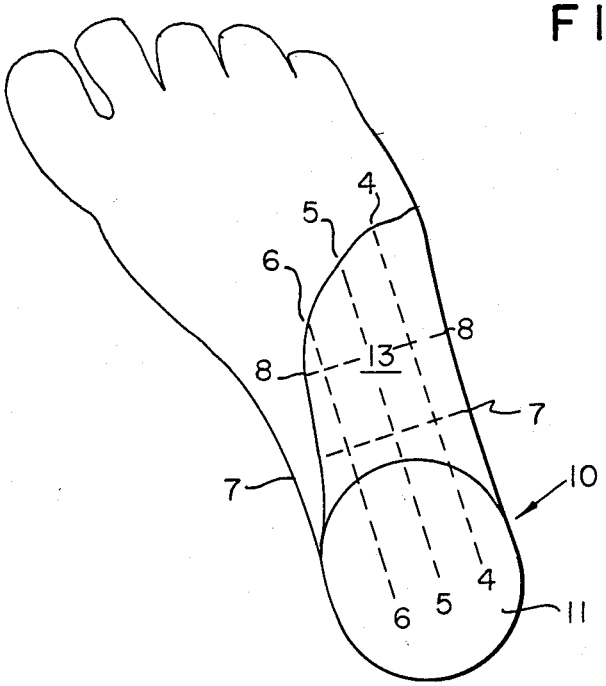
FIG. 1 shows a top view of the present invention as designed for use with a right foot, with the outline of the right foot superimposed thereon.

With reference first to FIG. 1, a first example of the wedge in accordance with the teachings of the present invention is generally designated by the reference numeral 10 and is seen to include a heel supporting portion 11 of substantially constant thickness and a forward portion 13 connected thereto and extending forward to just rearward of the location of the ball of a foot which is standing on the wedge 10.

Figure 2:
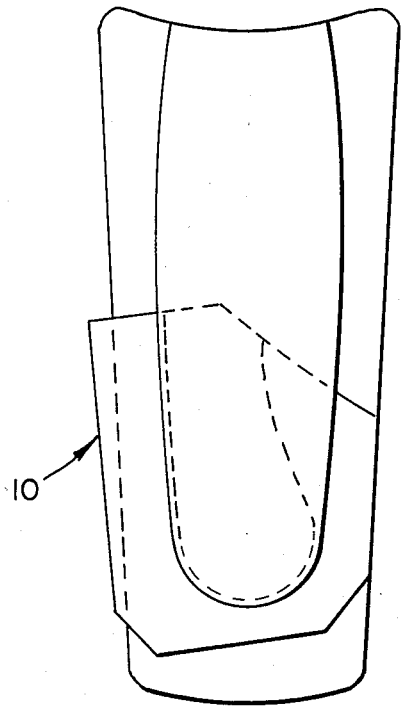
FIG. 2 shows a top view of the invention as designed for use with a left foot, when installed, with the outline of the binding.

The wedge 10 shown in FIG. 1 is specifically designed for use with the right foot. With reference to FIG. 2, the wedge 10' is designed for use with the left foot and constitutes a mirror-image of the structure of the wedge 10.

With reference to FIG. 3, the wedge 10' is seen to include a heel supporting portion 11' of substantially constant thickness and a forward portion 13' which extends forward to just rearward of the ball of the foot 1 which is seen in FIG. 3 as it would be properly placed on the wedge 10'.

FIGS. 4, 5, 6, 7 and 8 show cross-sectional views in various directions and locations of the forward portion 13 as shown by the lines 4—4, 5—5, 6—6, 7—7 and 8—8 respectively, in FIG. 1.

FIGS. 4–8 demonstrate the specific configuration of the forward portion 13 of the wedge 10. In particular, as FIGS. 4–8 demonstrate, the forward portion 13 of the wedge 10 slopes downwardly from the heel direction to the toe direction and, in the transverse direction, slopes downwardly from the lateral side of the foot to the medial side of the foot. As is well understood, the lateral side of the foot is the outside thereof whereas the medial side of the foot is the inside thereof.

With reference back to FIG. 3, the forward termination of the forward portion 13' (and 13) is sufficiently rearward to allow the ball of the foot 1 to directly engage the top surface 4 of the water ski 2 seen in FIG. 9.

Also seen in FIG. 9 is the wedge 10, a rear binding 6 and a forward binding 8. As should be understood from comparison of FIGS. 1, 2 and 9, the rear binding 6 and the wedge 10 are designed to support the right foot of the user whereas the binding 8 is designed to retain the left foot of the user.

As was explained hereinabove, the inventive wedge 10 or 10' helps achieve proper slalom skiing body position, with improved balance, stability, ski control and consistency. The wedge 10 or 10, functions by directing most of the pressure from the body of the skier to the balls of both feet thereby keeping the knees comfortably tucked one behind the other at all times. Furthermore, the position of the rear foot caused by using the wedge 10 or 10' helps to bring the hips forward for a strong and proper slalom skiing body position.

Through the use of the wedge 10 or 10', a chain reaction is created. The rear heel of the rear foot is raised and the foot is thereby positioned to comfortably sit behind the front foot with this elevation of the rear heel directing more pressure to the ball of the rear foot while maintaining a solid contact area for the entire foot.

As is well known, the balls of the feet are the center of balance and control when the athlete is on his or her feet. With the rear heel elevated and more pressure being presented on the ball of the rear foot, the hips more easily move forward to the proper body position for skiing which directs more pressure to the ball of the front foot.

At the same time that the pressure is directed to the ball of the rear foot, the rear knee is automatically comfortably tucked behind the front knee at any degree that the knees are bent. The contour of the forward portion of 13 or 13' of the wedge to the lateral side of the foot combined with the level platform for the heel portion 11 or 11' thereof create these desired effects.

The increase of pressure to the balls of the feet enhances balance, stability and ski control. The proper body position with hips forward and knees comfortably tucked one behind the other increases strength and consistency. Of course, the wedge 10 or 10, of the present invention may also be used on double skis under any situation where the skier wishes to direct more weight to the balls of their feet while allowing the balls of their feet to directly engage the top surface of each respective ski.

In the preferred embodiment of the present invention, each wedge is made of a flexible material such as, for example, urethane 75-A, which material provides strong resilient support yet is able to withstand the detrimental effects of weathering from sunlight, salt water, etc.

If desired, each wedge could be integrally formed in the bindings when they are manufactured or, if desired, may be provided as a separate item to be selected by the water skier and installed on their skis after purchase. Of course, whatever means is necessary to separately install a wedge on a water ski should be evident to those skilled in the art.

In using the inventive wedge on a slalom ski, when the skier is traveling back and forth across the wake of the ski boat, turns are occurring on each side and during such turns, the body of the skier has a natural tendency to want to place pressure on the lateral side of each foot especially the rear foot. If this occurs, the skier's knees inherently spread apart and the hips move backward with the back bending forward at the waist. This action is most noticeable on the weak side turn and wake crossings. Under such circumstances, the skier often loses control and is pulled out of the proper body position. The use of the inventive water ski wedge keeps the pressure on the balls of the feet of the skier and the knees comfortably tucked one behind the other to keep the hips forward and the back perpendicular to the plane of the ski for proper body position thus increasing the skier's ski control, balance, stability, strength through the wake crossings and consistency to thereby result in enhanced performance.

As such, an invention has been described in terms of a preferred embodiment thereof which fulfills each and every one of the objects of the invention as set forth hereinabove and provides a new and improved device designed to be attached to or incorporated with a water ski for enhanced water skiing performance. Of course, various modifications, changes and alterations in the teachings of the present invention may be contemplated by those skilled in the art without departing from the intended spirit and scope thereof. As such, it is intended that the present invention only be limited by the terms of the appended claims.

What is claimed:

1. In a water ski having a top surface and at least one binding adapted to retain a foot of a water skier therein, the improvement comprising a wedge on said water ski including a heel portion adapted to support a heel of said foot and a forward portion forward of said heel portion adapted to support portions of said foot forward of said heel of said foot, said forward portion terminating at a forward termination rearward of a ball of said foot whereby said ball may directly engage said top surface of said water ski when said heel of said foot is on said heel portion, said forward portion of said wedge being tapered from a thickest region adjacent said heel portion to a thinnest region at said forward termination.

2. The invention of claim 1, wherein said water ski comprises a slalom ski with plural bindings.

3. The invention of claim 1, wherein said heel portion is of substantially uniform thickness.

4. The invention of claim 3, wherein said uniform thickness is approximately one half inch.

5. The invention of claim 1, wherein said wedge is for a left foot.

6. The invention of claim 1, wherein said wedge is for a right foot.

7. In a water ski having a top surface and at least one binding adapted to retain a foot of a water skier therein, the improvement comprising a wedge on said water ski including a heel portion adapted to support a heel of said foot and a forward portion forward of said heel portion adapted to support portions of said foot forward of said heel of said foot, said forward portion terminating at a forward termination rearward of a ball of said foot whereby said ball may directly engage said top surface of said water ski when said heel of said foot is on said heel portion, said forward portion of said wedge being tapered from a thickest region adjacent said heel portion to a thinnest region at said forward termination and being further tapered from a further thickest region corresponding to the lateral side of said foot to a further thinnest region corresponding to the medial side of said foot.

8. The invention of claim 7, wherein said water ski comprises a slalom ski with plural bindings.

9. The invention of claim 7, wherein said heel portion is of substantially uniform thickness.

10. The invention of claim 9, wherein said uniform thickness is approximately one half inch.

11. The invention of claim 7, wherein said wedge is for a left foot.

12. The invention of claim 7, wherein said wedge is for a right foot.

* * * * *